US010926279B2

(12) United States Patent
Ding

(10) Patent No.: US 10,926,279 B2
(45) Date of Patent: Feb. 23, 2021

(54) PRESSING PUMP

(71) Applicant: Yao Wu Ding, Jiangsu (CN)

(72) Inventor: Yao Wu Ding, Jiangsu (CN)

(73) Assignee: Yaowu Ding, Jiangsu (CN)

( * ) Notice: Subject to any disclaimer, the term of this patent is extended or adjusted under 35 U.S.C. 154(b) by 0 days.

(21) Appl. No.: 16/483,912

(22) PCT Filed: Dec. 11, 2017

(86) PCT No.: PCT/CN2017/115423
§ 371 (c)(1),
(2) Date: Sep. 20, 2019

(87) PCT Pub. No.: WO2018/145511
PCT Pub. Date: Aug. 16, 2018

(65) Prior Publication Data

US 2020/0016616 A1 Jan. 16, 2020

(30) Foreign Application Priority Data

Feb. 7, 2017 (CN) ..... 201710065090.6

(51) Int. Cl.
*B05B 11/00* (2006.01)

(52) U.S. Cl.
CPC .... *B05B 11/3015* (2013.01); *B05B 11/00442* (2018.08); *B05B 11/3074* (2013.01)

(58) Field of Classification Search
CPC ..... B05B 11/00442; B05B 11/3074; B05B 11/0008; B05B 11/30; B05B 11/3042; B05B 11/3073; B05B 11/3015
See application file for complete search history.

(56) References Cited

U.S. PATENT DOCUMENTS 4,739,904 A * 4/1988 Spencer ..... B05B 11/3015 222/109
5,397,035 A * 3/1995 Law ..... B05B 11/007 222/383.1

(Continued)

FOREIGN PATENT DOCUMENTS

CN 2386750 Y 7/2000
CN 101772462 A 7/2010

(Continued)

OTHER PUBLICATIONS

International Search Report and Written Opinion dated Mar. 9, 2018, for corresponding International Application No. PCT/CN2017/115423; International Filing Date: Dec. 11, 2017; consisting of 9-pages.

*Primary Examiner* — Vishal Pancholi
*Assistant Examiner* — Bob Zadeh
(74) *Attorney, Agent, or Firm* — Christopher & Weisberg, P.A.

(57) ABSTRACT

A press pump (1) comprises a press pump body 10) in which a spring tube (20) is provided, a spring (21) is contained within the spring tube (20); a cylinder head (30) mounted on the press pump body 10) and including a internal bore (31); a press head (40) including a pressing portion (41) and a rod portion (42), the rod portion (42) is fit within the internal bore (31) of the cylinder head (30), and a lower portion of the rod (42) engages with the spring (21), so that the spring (21) applies an upward bias force on the press head (40); and a piston (50) connected to the press head (40) and is slidably and sealingly engaged with the internal circumference of the press pump body 10). The press pump (1) can use a spring (21) with relatively small size, while meet the requirement of large displacement, thus reducing manufacturing cost, (Continued)

and also can prevent contact between the product and the spring (21), avoiding negative effects between them.

7 Claims, 4 Drawing Sheets

(56) References Cited

U.S. PATENT DOCUMENTS

| | | | | |
|---|---|---|---|---|
| 6,422,434 | B1 * | 7/2002 | Lammond Wass | B05B 11/0005 222/571 |
| 10,677,256 | B1 * | 6/2020 | Govaert | F04D 29/126 |
| 2006/0006196 | A1 * | 1/2006 | Dumont | B05B 11/3074 222/321.4 |
| 2009/0302064 | A1 * | 12/2009 | Lavabre | B05B 11/00442 222/207 |
| 2020/0016616 | A1 * | 1/2020 | Ding | B05B 11/3015 |

FOREIGN PATENT DOCUMENTS

| | | | |
|---|---|---|---|
| CN | 203064485 | U | 1/2013 |
| CN | 203158449 | U | 8/2013 |
| CN | 104724378 | A | 6/2015 |
| CN | 206734939 | U | 12/2017 |
| JP | H09301410 | A | 11/1997 |
| JP | 2013052896 | A | 3/2013 |

* cited by examiner

PRESSING PUMP

CROSS-REFERENCE TO RELATED APPLICATIONS

This application is a Submission under 35 U.S.C. § 371 for U.S. National Stage Patent Application of, and claims priority to, International Application Number PCT/CN2017/115423 entitled PRESSING PUMP, filed Dec. 11, 2017, which is related to and claims priority to Chinese Patent Number 201710065090.6 filed Feb. 7, 2017, the entirety of all of which are incorporated herein by reference.

FIELD OF THE DISCLOSURE

The present invention relates to a press pump, which is especially mounted on a container for containing liquid products such as alcohol, mouthwash, and is used for dispensing the product contained therein.

BACKGROUND

In the field of products such as alcohol, mouthwash, sometimes a container with pressing pump will be used for packaging such products, and the product in the container is dispensed by pressing down the press pump. Because of the characteristic of the alcohol and the mouthwash, the press pump used for such product is required to have relatively large displacement, so as to meet the requirements of the consumers.

In order to meet such requirements, the pressing pump of such a type available is provided with a metal spring, and the overall diameter, wire diameter, and length of such a metal spring are set relatively large, so that pump capacity can be provided as large as possible. In addition, the press pump generally used in the market is normally provided with an externally disposed spring, such an externally disposed spring is arranged around a piston rod. So, the spring is to be manufactured with a relatively large diameter, and correspondingly, in order to guarantee a sufficient spring force of the spring, it is necessary to make the spring with a thicker wire, and the length of the spring shall also be relatively large.

Generally speaking, spring is made of stainless steel, thus the cost of manufacturing increases as the size of the spring increases. So, in the prior art press pump for pumping products such as alcohol and mouthwash, the cost of the spring is relatively high.

In addition, for the press pump with an externally disposed spring, the spring may be in contact with the product such as alcohol, mouthwash contained in the container, thus on the one hand, the product will affect the spring, sometimes corrodes the spring, and on the other hand, the spring will contaminate the product, for example, in case that the product contained in the container is alcohol, the flavor of the alcohol may be changed by being in contact with the spring, and for the product such as mouthwash, its effects will also be negatively affected by contacting the spring.

So, it is necessary to have improvement on the press pump, to lower the cost, and to avoid mutual effects between the spring of the press pump and the products.

SUMMARY

The present invention is to overcome the above-mentioned technical problem of the existing press pump. An object of the present invention is to provide a press pump, which can use a spring of relatively small size so as to lower the manufacturing cost. Further, the press pump is able to avoid a direct contact between the spring and the product contained in the container, so as to solve the problem that they affect each other.

The press pump of the present invention comprises a press pump body in which a spring tube is provided, a spring is contained within the spring tube; a cylinder head mounted on the press pump body and including a internal bore; a press head including a pressing portion and a rod portion, the rod portion is fit within the internal bore of the cylinder head, and a lower portion of the rod engages with the spring, so that the spring applies a upward bias force on the press head; and a piston connected to the press head and is slidably and sealingly engaged with the internal circumference of the press pump body.

In the press pump of the abovementioned structure, a spring tube is provided in the press pump body for containing the spring, so that the spring is internally disposed. Thus, the spring is not needed to be provided around parts such as a piston rod, therefore the size of thereof, including its sectional diameter, length and the like, can be reduced, and the wire diameter of the spring can be correspondingly reduced while still meeting the requirement of large displacement for the product such as alcohol, mouthwash and the like. Thus, the material for manufacturing the spring, such as stainless steel, can be saved, thus lowering the manufacturing cost. And, by containing the spring within a spring tube, the spring can be isolated in some extent from the product contained in the container, thus preventing them from contacting each other, and avoiding any negative effects therebetween.

Preferably, a spring tube mount is provided within the press pump body, the spring tube is securely mounted in the spring tube mount, wherein an engaging recess is provided on one of an outer circumferential surface of the spring tube and an inner circumferential surface of the spring tube mount, and an engaging annular rib is provided on the other one of the outer circumferential surface of the spring tube and the inner circumferential surface of the spring tube mount.

Preferably, the piston includes an inner ring and an outer ring, the inner ring is slidably and sealingly engaged with the outer circumferential surface of the spring tube, and the outer ring is slidably and sealingly engaged with the inner circumferential surface of the press pump body. By means of the sealing effect of the inner ring and the out ring, the spring can be further isolated from the product contained in the container.

In one embodiment, the rod portion of the press head can include an inner sleeve and an outer sleeve, the inner sleeve abuts against the spring, and the piston connects to the outer sleeve.

Preferably, an opening is provide at a lower portion of the press pump body, a outlet conduit is connected to the opening, and the outlet conduit is connected to the opening integrally or detachably. By providing the outlet conduit on the press pump body, the outlet conduit can be kept stationary during the press head being pressed down, thus facilitating the user in getting the product pumped from the container by means of a vessel such as a cup.

Preferably, at least one step is provided in the internal bore of the cylinder head, at least one boss is provided on an outer circumferential surface of the press head, the boss can engage with the step, for limiting a pressing stroke of the press head.

A vent can be provided on the press pump body as a pressure balancing structure, an elastic sheet is provided at an inner side of the vent, the elastic sheet covers the vent, and only when the pressure within the container mounted with the press pump is smaller than ambient pressure by a predetermined pressure value, the elastic sheet deforms under action of the ambient pressure, thus opening the vent.

DETAILED DESCRIPTION OF THE INVENTION

Figure 1A:
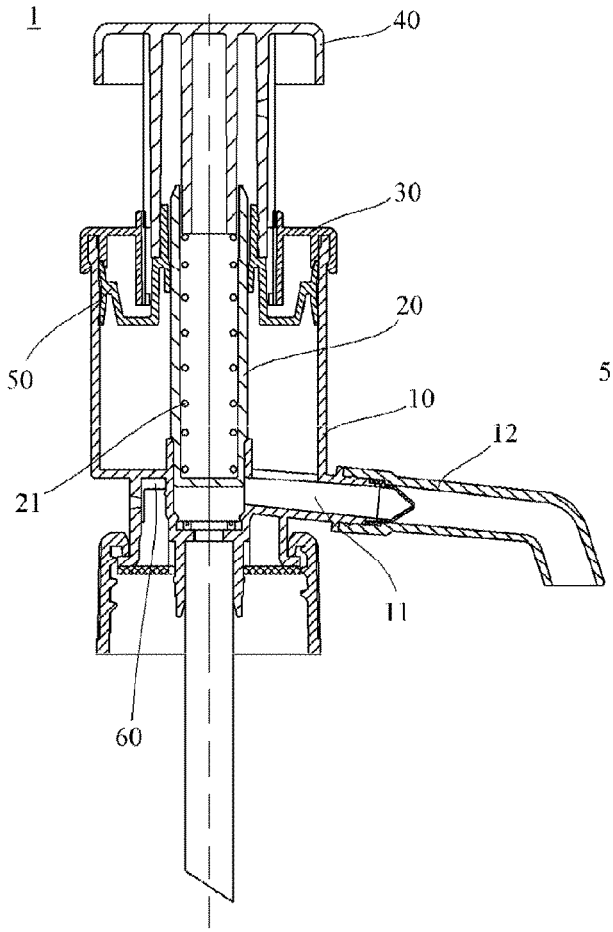
FIG. 1*a* shows a cross sectional view of the press pump of the present invention, in which the press pump is in an upper rest state.

For facilitate in understanding the present invention, embodiments of the present invention will be illustrated below by referring to FIGS. 1*a*-7. However, it is to be understood that the drawings only show preferred embodiments of the present invention, and it shall not be understood as a limit of the scope of the present invention. One skilled in the art can make various modification, variation and equivalent replacement to the present invention based on the embodiment shown in the drawings, and the features in the embodiments can be combined in any way providing there is no confliction, and all these are in the protective scope of the present invention.

In the context of the present invention, the terms for expressing directions or orientations, such as "upper", "lower" and the like are used as that shown in the drawings. In use, the orientation of the press pump can be changed as required. For example, the press pump, during use, may form an angle with respect the horizontal direction, and even it may be disposed horizontally, instead of being disposed in an upper and lower direction as shown in the drawings.

<Overall Structure>

Figure 1B:
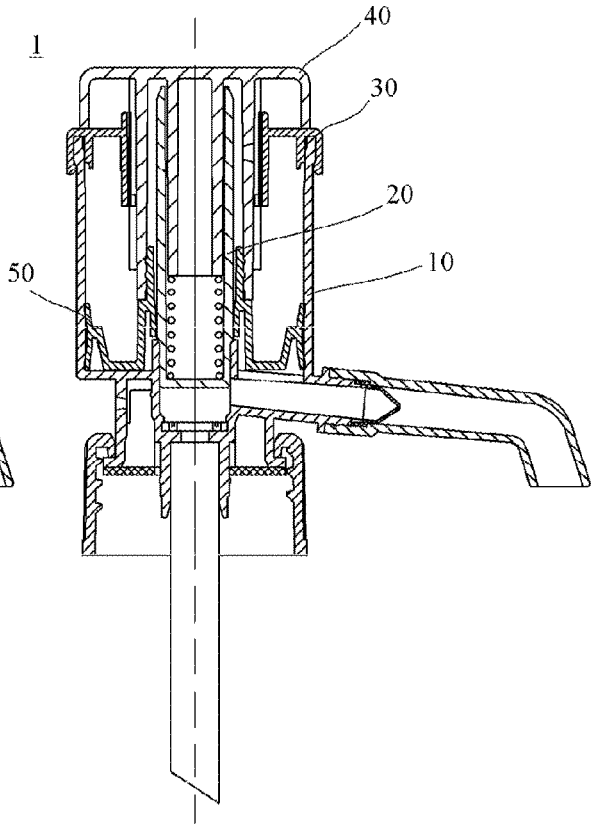
FIG. 1*b* shows another cross sectional view of the press pump of FIG. 1*a*, in which the press pump is in a lower pressed state.

FIGS. 1*a* and 1*b* shows cross sections of the press pump 1 of the present invention in two different states, wherein the press pump 1 shown in FIG. 1 is in an upper rest state, and the press pump 1 shown in FIG. 1*b* is in a lower pressing state.

The press pump 1 can be used for a container (not shown) containing such products as alcohol, mouthwash and the like.

The press pump 1 includes a press pump body 10, a spring tube 20 is secured in the press pump body 10. The spring tube 20 and the press pump body 10 can be manufactured separately, and then be assembled together, or the spring tube can be integrally formed in the press pump body 10. However, in view of the flexibility and convenience in use and manufacture, it is preferable that the press pump body 10 and the spring tube 20 be detachably assembled together. A spring 21 is contained within the spring tube 20.

The press pump 1 further includes a cylinder head 30 covered on the press pump body 10. Likely, the cylinder head 30 also can be formed integrally with the press pump body 10, or they can be formed separately and then assembled together. The cylinder head 30 includes an internal bore 41, in which a press head 40 can be fitted, which will be described in detail below.

The press head 40 can be fitted with a piston 50 slidably and sealingly engaged at least with an inner surface of the press pump body 10.

The structure of the press pump 1 shown in the drawings uses the spring tube 30 for containing the spring 21. Thus, the spring 21 needs not to be disposed around such structures as a rod portion 42 of the press head 40, thus the cross section area of the spring 21 may be designed to be relatively small, and the length and wire diameter of the spring 21 can also be reduced correspondingly, with the elastic force of the spring 21 substantially unaffected.

And, since the spring 21 is contained within the spring tube 20, the spring tube 20 functions, in some extent, to isolate the spring 21 from the product contained in the container.

The detailed structure of the various parts of the press pump 1 will be described below with reference to FIGS. 2-7.

<Spring Tube and Press Pump Body>

Figure 2:
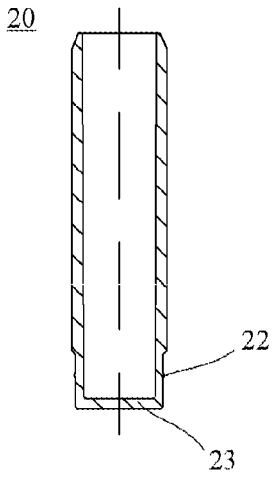
FIG. 2 shows a cross sectional view of a spring tube of the press pump in FIGS. 1*a* and 1*b*.
Figure 3:
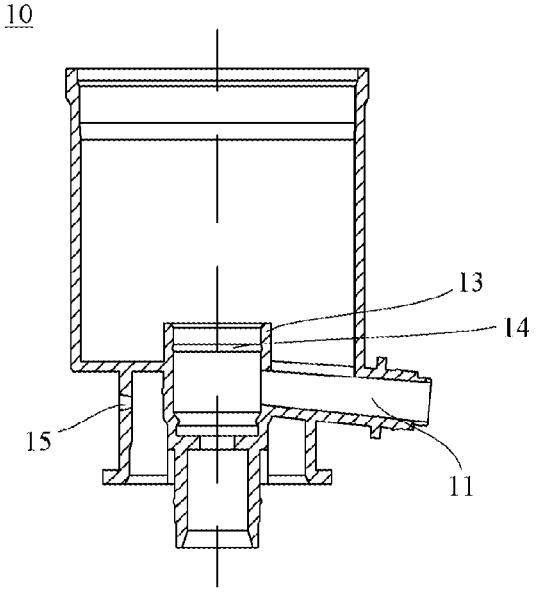
FIG. 3 shows a cross sectional view of a press pump body of the press pump in FIGS. 1*a* and 1*b*.

FIG. 2 shows a cross section of the spring tube 20, and FIG. 3 shows a cross section of the press pump body 10. As shown in FIG. 3, a spring tube mount 13 is provided on the press pump body 10, an engaging recess 14 is formed on an inner wall of the spring tube mount 13, and corresponding thereto, an engaging annular rib 22 is provided at a lower part of the spring tube 20 (as shown in FIG. 2). When the spring tube 20 is fit in the cylinder head 30, the engaging annular rib 22 is snap fit into the engaging recess 14, thus the spring tube 20 is mounted into the press pump body 10 by a snap fitting.

Of course, the above-mentioned structure can be subjected to any obvious change, for example, the positions where the engaging annular rib and the engaging recess are provided can be exchanged, i.e. the spring tube 20 is provided with the engaging recess, and the engaging annular rib can be provided on the spring tube mount 13 of the press pump body 10, with the object of the present invention can still be realized.

Furthermore, as shown in FIG. 2, the upper end of the spring tube 20 is open for disposing the spring 21, and the bottom 23 of the spring tube 20 is closed for supporting the spring 21, and the spring tube 20 can be separated from the other parts of the press pump body 10. In this respect, some modifications are also possible, for example, both ends of the spring tube 20 are open, and a baffle can be formed in the spring tube mount 13, the baffle functions to support the spring 21 and isolate the spring tube 20.

In addition, a lower portion of the press pump body 10 can be provided with an opening 11, to which a outlet conduit 12 can be connected, as shown in FIGS. 1*a* and 1*b*. The outlet conduit 12 can be detachably connected to the opening 11, or can be integrally formed on the opening 11.

Of course, the opening can be provided at other positions, for example, it can be provided on the press head 40, and a communication channel is provided between the press head 40 and the inside portion of the press pump body 10.

However, it is preferred to provide the opening 11 at the lower portion of the press pump body 10, by doing so, when the press head 40 is pressed downwardly for dispensing product in the container, the outlet conduit 12 will not move up and down with the press head 40, instead, it will remain stationary, so that the user can easily catch the product pumped from the container by the press pump 1 by using a vessel such as a cup.

<Cylinder Head and Press Head>

Figure 4A:
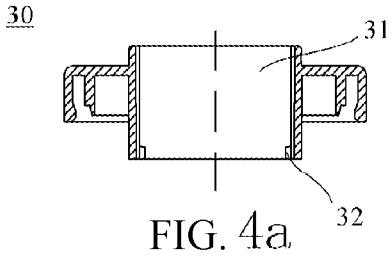
FIG. 4*a* shows a cross sectional view of a cylinder head of the press pump in FIGS. 1*a* and 1*b*.
Figure 4B:
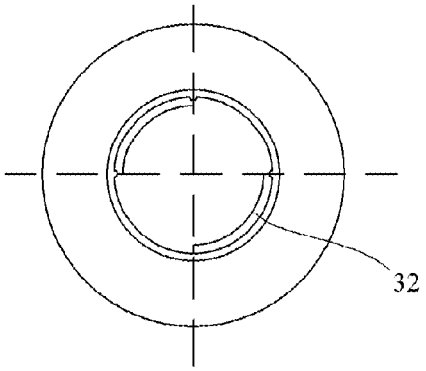
FIG. 4*b* shows a top view of the cylinder head of FIG. 4*a*.
Figure 5:
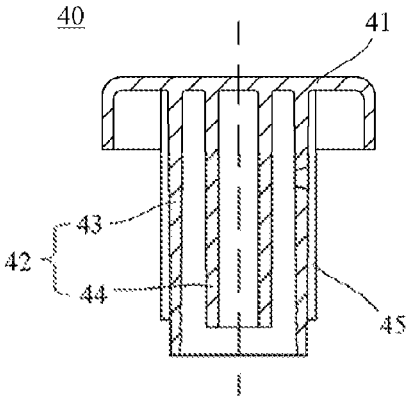
FIG. 5 shows a cross sectional view of a press head of the press pump in FIGS. 1*a* and 1*b*.

FIGS. 4*a* and 4*b* respectively show cross sectional view and top view of the cylinder head 30 of the press pump 1, and FIG. 5 shows a cross sectional view of the press head 40. As shown in FIGS. 4*a* and 4*b*, an internal bore 31 is provided in the cylinder head 30, and the press head 40 shown in FIG. 5 includes a pressing portion 41 and a rod portion 42 connecting to the pressing portion 41 and extending downwardly, the rod portion 42 of the press head 40 is able to extend into the internal bore 31 of the cylinder head 30.

Preferably, as shown in FIG. 5, the rod portion 42 of the press head 40 includes an outer sleeve 43 and an inner sleeve 44. It can be seen from the cross sectional views of FIGS. 1*a* and 1*b*, which show the assembled state of the press pump 1, that an lower end of the inner sleeve 44 can be engaged with the spring 21 in the spring tube 20, so that the spring 21 applies an upward bias force on the press head 40 via the inner sleeve 44. The outer sleeve 43 is connected with a piston. The detailed structure and arrangement of the piston will be described in detail below.

Of course, in addition to the structure of the outer sleeve and inner sleeve, the rod portion 42 of the press head 40 may be other forms, such as includes merely one sleeve, which engages with the spring 21, and is mounted with a piston.

In addition, optionally as shown in FIGS. 4*a* and 4*b*, at least one step 32 is formed at an inner wall of the internal bore 31 of the cylinder head 30, the step 32 is preferably located at a lower portion of the cylinder head 30, and is more preferably provided close to the bottom of the cylinder head 30. Correspondingly, at least one boss 45 is formed on an outer circumference of the rod portion 42 of the press head 40. When the press head 40 is pressed down to pump the product, the boss 45 will move downwardly together with the press head 40, and finally contact the step 32, at that time the step 32 will stop the press head 40 from further moving downwardly, so as to limit the pressing stroke of the press head 40.

The step 32 and the boss 45 can be provided in various ways. For example, there are two steps 32 shown in FIG. 4*b*, and correspondingly, two bosses 45 are provided at positions on the outer circumferential surface of the rod portion 42 of the press head 40 that substantially align with the two steps 32. Alternatively, at least one of the steps 32 and the bosses 45 can be formed as a continuous annular rib. In addition, the number of the steps 32 and the number of the bosses 45 can be equal, or can be different, and the function of limiting the press stroke can be substantially achieved so long as the at least one step 32 and at least one boss 45 are in contact with each other during the press head 40 is pressed down.

<Piston>

Figure 6:
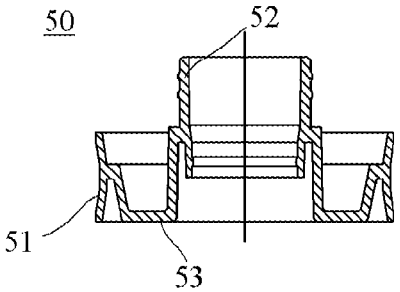
FIG. 6 shows a cross sectional view of a piston of the press pump in FIGS. 1*a* and 1*b*.

FIG. 6 shows a cross sectional view of a piston 50 in the press pump 1. As shown in FIG. 6, the piston 50 includes an outer ring 51, an inner ring 52 and a connection portion 53 connecting the outer ring 51 and the inner ring 52 together.

In the assembled state, as shown in FIG. 1*a*, the inner ring 52 slidably contacts with the outer circumferential surface of the spring tube 20, and forms a seal between the inner ring 52 and the outer circumferential surface of the spring tube 20; the outer ring slidably contacts the inner circumferential surface of the press pump body 10, and forms a seal between the outer ring and the inner circumferential surface of the press pump body 10.

By means of the structure of the piston 50 in FIG. 10, the spring tube 20 can be separated from the space of the press pump body 10 containing the product, thus further effectively preventing the contact between the product and the spring 21 in the spring tube 20, and hence the negative effects between the spring 21 and the product.

The shape and structure of the connect portion 53 can be designed according to the specific structure of the press pump 1, for example, it can be the structure with curved portion as shown in FIG. 6, so that it can comply with the shape of the other parts in the press pump 1. Of course, if the space in the press pump 1 allows, the connect portion can also be formed into a flat shape.

<Elastic Sheet>

Preferably, a vent 15 can be provided on the press pump body 10 (see FIGS. 1*a*, 1*b* and 3), for balancing the pressure within the container mounted with the above mentioned press pump 1. Furthermore, an elastic sheet 60 can be provided in the press pump body 10, for controlling on/off of the vent 15.

Figure 7:
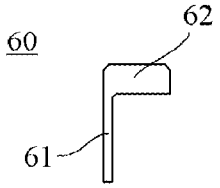
FIG. 7 shows an elastic sheet provided in the press pump body for controlling open and close of the vent in the press pump body.

FIG. 7 shows a side view of the elastic sheet 60. The elastic sheet 60 includes a fixing portion 61 and an elastic portion 62 connected to the fixing portion 61. The fixing portion 61 is fixedly connected in the press pump body 10, and the elastic portion 62 covers the vent 15 on the press pump body 10.

The elastic portion 62 is configured so that when a difference between the pressure in the container and the ambient pressure reaches a predetermined value, the pressure difference of the predetermined value flexes the elastic portion 62 inwardly, thus opening the vent 15 for balancing the pressure within the container. On the other hand, if the difference between the pressure in the container and the ambient pressure does not reach a predetermined value, the elastic portion 62 abuts against the vent 15, thus closing the vent 15 and preventing the ambient air from entering.

The force needed for flexing the elastic portion 62 can be set by selecting parameters of the elastic portion 62 such as material, size and the like.

The invention claimed is:

1. A press pump comprising:

a press pump body having an internal circumference, a spring tube, a spring being contained within the spring tube, wherein a bottom of the spring tube is closed for supporting the spring;

a cylinder head being mounted on the press pump body, and including an internal bore;

a press head having a pressing portion and a rod portion, the rod portion fitting within the internal bore of the cylinder head, and a lower part of the rod portion engaging with the spring such that the spring applies an upward bias force on the press head; and a piston connected to the press head and being slidably and sealingly engaged with the internal circumference of the press pump body.

2. The press pump of claim 1, wherein a spring tube mount is provided within the press pump body, the spring tube being securely mounted on the spring tube mount, where an engaging recess is provided on one of an outer circumferential surface of the spring tube and an inner circumferential surface of the spring tube mount, and an engaging annular rib on the other one of the outer circumferential surface of the spring tube and the inner circumferential surface of the spring tube mount.

3. The press pump of claim 1, wherein the piston further includes an inner ring and an outer ring, the inner ring being slidably and sealingly engaged with the outer circumferential surface of the spring tube, and the outer ring is slidably and sealingly engaged with the inner circumferential surface of the press pump body.

4. The press pump of claim 1, wherein the rod portion of the press head has an inner sleeve and an outer sleeve, the inner sleeve abuts against the spring, and the piston, is connected to the outer sleeve.

5. The press pump of claim 1, wherein an opening is provided at a lower portion of the press pump body, an outlet conduit is connected to the opening, and the outlet conduit is connected to the opening integrally or detachably.

6. The press pump of claim 1, wherein at least one step is provided in the internal bore of the cylinder head, at least one boss is provided on an outer circumferential surface of the press head, the boss being engageable with the step for limiting a pressing stroke of the press head.

7. The press pump of claim 1, further comprising a container wherein a vent is provided on the press pump body for balancing a pressure in the container, an elastic sheet is provided at an inner side of the vent, the elastic sheet covering the vent, and only when the pressure in the container mounted with the press pump is smaller than an ambient pressure by a predetermined pressure value, the elastic sheet deforms under action of the ambient pressure, thus opening the vent.

* * * * *